US005454236A

United States Patent [19]

Taniguchi

[11] Patent Number: 5,454,236

[45] Date of Patent: Oct. 3, 1995

[54] DEVICE FOR TREATING CUT END OF KNITTED FABRIC ON ROLLING UNIT OF CIRCULAR KNITTING MACHINE

[75] Inventor: Kozo Taniguchi, Kobe, Japan

[73] Assignee: Precision Fukuhara Works, Ltd., Japan

[21] Appl. No.: 945,131

[22] Filed: Sep. 15, 1992

[30] Foreign Application Priority Data

Sep. 20, 1991 [JP] Japan ..... 3-270088

[51] Int. Cl.[6] ..... D04B 15/88

[52] U.S. Cl. ..... 66/151; 66/153

[58] Field of Search ..... 66/153, 152, 151, 66/150, 149 R, 147, 148; 242/547, 381.2, 906, 152, 548; 83/909, 913, 936, 937, 938, 939

[56] References Cited

U.S. PATENT DOCUMENTS

| | | | |
|---|---|---|---|
| 402,551 | 4/1889 | Winn | 242/547 |
| 1,987,141 | 1/1933 | Casper | 242/547 |
| 3,760,609 | 4/1973 | Poocza et al. | 66/152 |
| 3,924,395 | 12/1975 | Grossi | 37/34.5 |
| 4,027,506 | 6/1977 | Bitzer | 66/149 R |
| 4,079,600 | 3/1978 | Amaya et al. | 66/56 |
| 4,652,252 | 11/1986 | Balz | 242/906 |
| 4,667,894 | 5/1987 | Izuchi et al. | 66/151 |
| 4,765,157 | 8/1988 | Okada | 66/149 R |
| 4,888,963 | 12/1989 | Scherzinger et al. | 66/151 |
| 5,106,896 | 4/1992 | Endo et al. | 524/318 |
| 5,224,362 | 7/1993 | Sawazaki | 66/151 |

*Primary Examiner*—Clifford D. Crowder
*Assistant Examiner*—Larry D. Worrell, Jr.
*Attorney, Agent, or Firm*—Bell, Seltzer, Park & Gibson

[57] ABSTRACT

Fabric knitted upon a circular knitting machine and conducted downwardly by delivery rolls to a fabric cutter and thence to a fabric winding reel is prevented from being recaptured by the delivery rolls, and is also prevented from becoming adhered to a guide plate due to the presence of static electricity. Recapture of the cut end of the fabric is prevented by a presser that presses the fabric against one of the delivery rolls, and prevention of adherence of the fabric to the guide plate is prevented by alternating ridges and channels and/or anti-static material upon the face of the plate that confronts the reel.

9 Claims, 3 Drawing Sheets

DEVICE FOR TREATING CUT END OF KNITTED FABRIC ON ROLLING UNIT OF CIRCULAR KNITTING MACHINE

BACKGROUND OF THE INVENTION

This invention relates to circular knitting machines having fabric take-up mechanisms that wind the knitted fabric produced by the machines upon reels, and that cut the fabric when a preselected amount of fabric has been wound upon each reel. The invention more specifically relates to an improved take-up mechanism that reduces if not altogether obviates the possibility of the trailing end portion of the fabric upon the reel being re-engaged and caught up by one of the fabric delivery rolls of the knitting machine during passage of the trailing end portion of the fabric downwardly from such rolls. This in turn reduces the possibility of take-up of the fabric being disrupted.

FIELD OF THE INVENTION

As is well known to those skilled in the art, fabric knitted into a cylindrical shape by the knitting unit of a circular knitting machine is conducted downwardly from the knitting unit by delivery rolls located beneath it, and is then wound up in a flattened condition on the cylindrical shaft of a reel located below the delivery rolls. The fabric rolled upon the shaft of each reel is cut, removed while the reel is unlocked, and is then again rolled at the leading end thereof upon the reel. The foregoing operation was performed manually for many years, but is now also performed entirely automatically. Irrespective of whether performed manually or automatically, the fabric becomes less tense when in a rolled condition, and rapidly contracts when cut. This results in the end portion of the fabric moving upwardly and being re-engaged by a delivery roll. When the fabric take-up mechanism is of an automated type, it is more likely that static electricity generated by guides that direct the fabric onto the reel shaft will cause the fabric to be attracted to such guides and to not be wound upon the reel. Occurrence of either one of the aforesaid undesirable situations results in considerable machine down time and fabric waste.

SUMMARY OF THE INVENTION

The present invention provides a fabric take-up mechanism that performs its intended function more efficiently and reliably, and which therefore lessens machine down time and fiber waste. The mechanism includes fabric pressing means that engages the fabric passing downwardly from the delivery rolls of the knitting machine and that minimizes the possibility of the fabric being inadvertently re-engaged by the delivery rolls following its downward passage from them. In a preferred embodiment, the pressing means is a cylindrical shaft that presses the fabric against a delivery roll. The mechanism of the invention further includes a fabric guide that is biased for pivotal movement toward the center of the shaft of a reel roll upon which the fabric is wound. In order to prevent adherence of the fabric to the fabric guide, it is provided with alternating channels and ridges upon the side thereof facing the creel roll, and preferably is also provided with means for preventing or at least minimizing the possibility of static electricity causing the fabric to adhere to the fabric guide.

DESCRIPTION OF THE DRAWINGS

Other features of the invention will be apparent from the following description of preferred embodiments thereof, which should be read in conjunction with the accompanying drawings in which.

DESCRIPTION OF THE PREFERRED EMBODIMENTS

Figure 1:
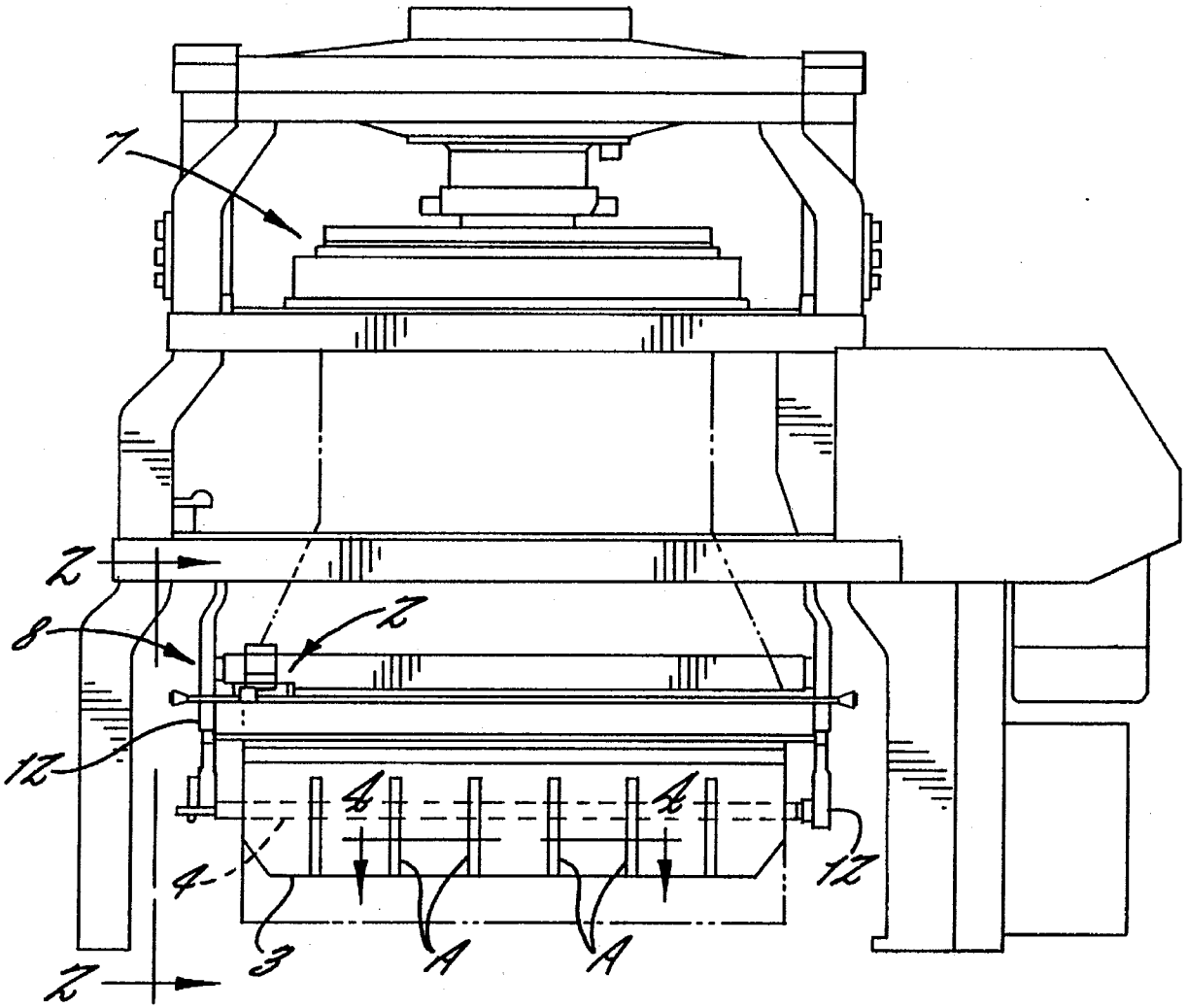
FIG. 1 is an elevational view of a circular knitting machine having a fabric take-up mechanism in accordance with the invention.

The circular knitting machine 1 shown in FIG. 1 produces knitted fabric (indicated by phantom lines) that is conducted downwardly by delivery rolls 5 (best shown in FIGS. 2 and 3) to a fabric take-up mechanism 8 that includes a reel roll 4 upon which the fabric is wound. Mechanism 8 is supported by frame 12 of machine 1 and further includes pressing means for pressing the fabric against one of the delivery rolls 5; a cutting device 2 for cutting the fabric when a desired quantity of it has been wound upon reel roll 4; and a fabric guide 3 for guiding the fabric onto reel roll 4.

Figure 2:
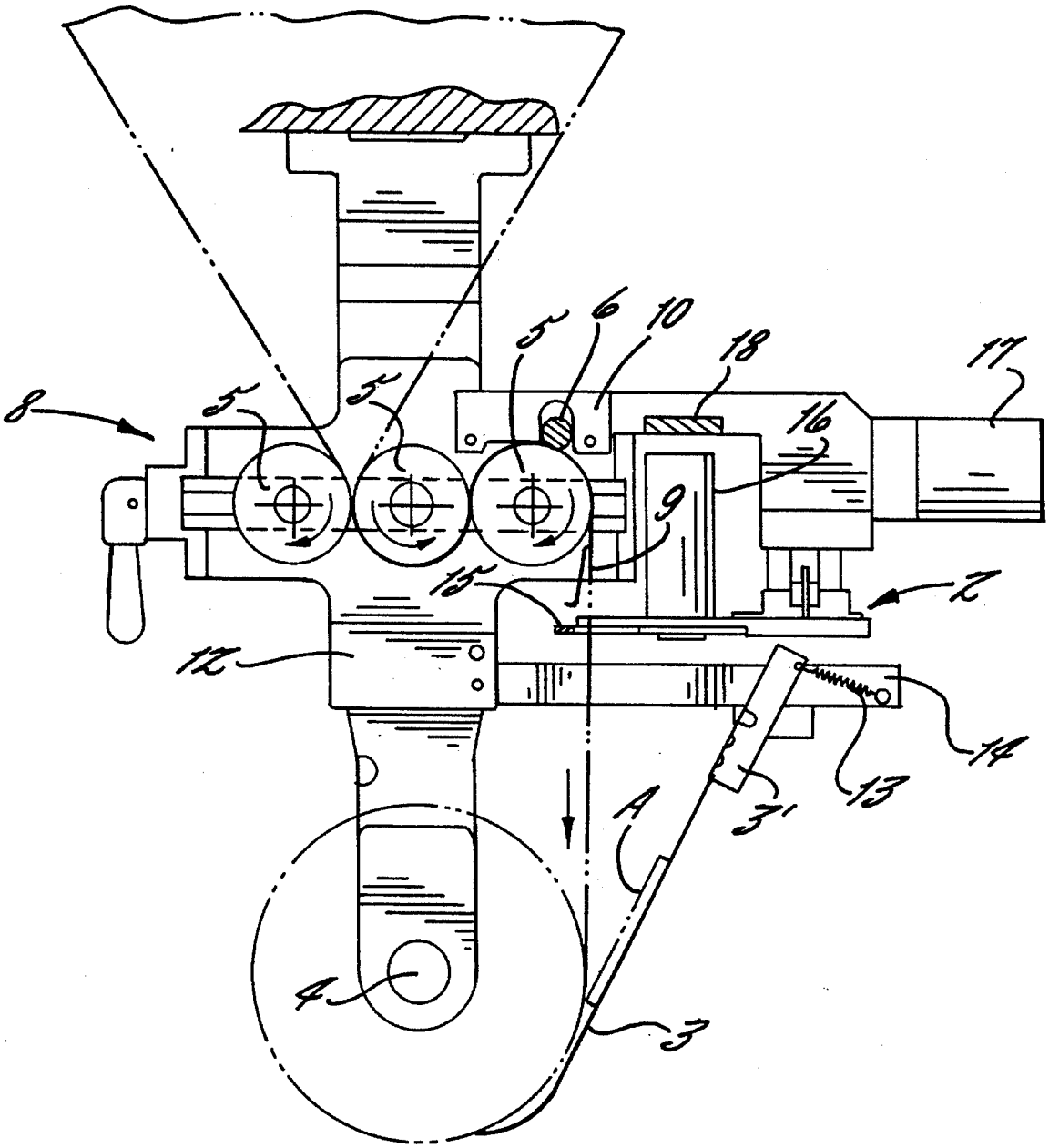
FIG. 2 is a side view taken in the direction of the arrows 2—2 of FIG. 1 of the fabric take-up mechanism and adjacent components of the knitting machine.

In the embodiment thereof shown in FIG. 2, the fabric pressing means includes a cylindrical shaft which illustratively is of solid construction, but which may alternatively be of tubular construction. The pressing means further includes a shaft retainer 10 that retains shaft 6 in engagement with the fabric passing over the rightmost (as viewed in FIG. 2) delivery roll 5, while permitting rotative movement of shaft 6 about its central axis. The pressing force imposed upon the fabric by roll 6 minimizes the possibility of the cut end of the fabric being re-engaged by one of the delivery rolls as it passes downwardly from the elevation of such rolls.

The cutting device 2 of mechanism 8 includes a cutter blade 15 driven by a motor 16 that is mounted by a frame member 18 for translatory movement toward and away from the path of travel of the fabric. Such movement is imparted to member 18 at desired times by a drive member 17.

As is best shown in FIG. 2, fabric guide plate 3 is mounted adjacent the lower end of an elongate support member 3' that is pivotally connected adjacent its upper end to an extension of frame 12. A spring 13 connected to the upper end of support 3' biases the lower end of support 3' and guide plate 3 toward the fabric being wound upon roll 4. To prevent adherence of the fabric to fabric guide 3, the face of the guide that confronts roll 4 has upon it a plurality of alternating ridges A and channels B. These reduce the amount of surface contact between the fabric and guide plate 3. To reduce the possibility of adherence of the fabric to plate 3 due to static electricity, a layer of anti-static material 13, or a static electricity discharge device (not shown), may be provided upon plate 3.

Figure 3:
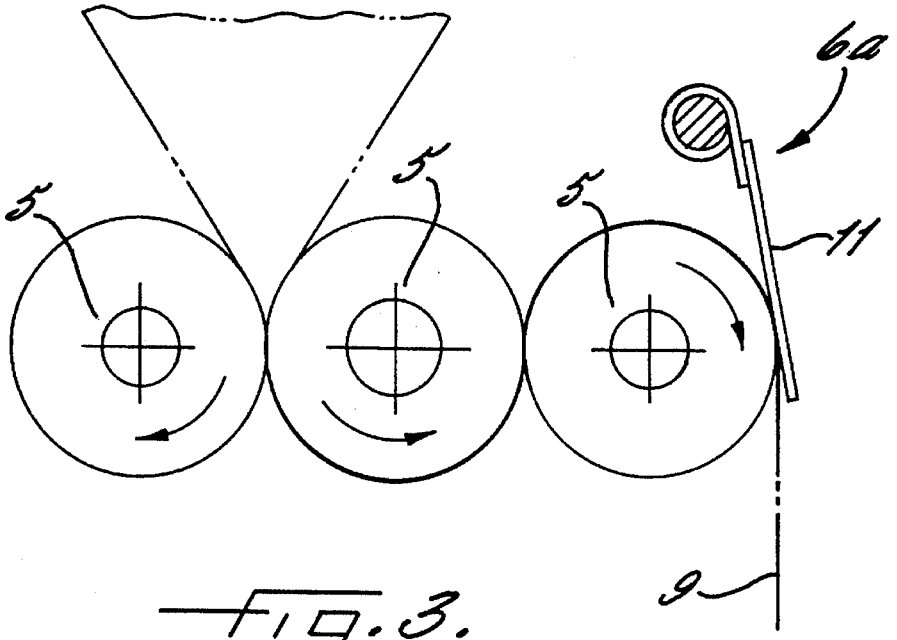
FIG. 3 is an enlarged side elevational view of delivery rolls of the mechanism and of a therewith associated pressing means of a second embodiment.
Figure 4:
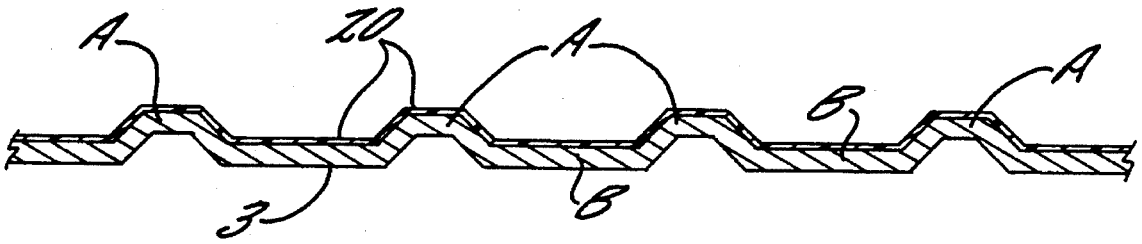
FIG. 4 is a fragmentary sectional view, taken substantially along the lines and in the direction of the arrows 4—4 of FIG. 1, through a fabric guide of the mechanism.

FIG. 3 shows an additional embodiment of a pressing means **6*a* for pressing the fabric against delivery roll 5. The pressing means 6*a* consists of a pivotally movable plate 11** that is biased by its own weight into engagement with the fabric passing upon the rightmost (as viewed in FIG. 3) delivery roll 5.

While preferred embodiments of the invention have been shown and described, this was for purposes of illustration only, and not for purposes of limitation, the scope of the invention being in accordance with the following claims.

I claim:

1. In a circular knitting machine having a frame, a knitting section carried by said frame, and a plurality of fabric delivery rolls carried by said frame beneath said knitting section, the combination of a mechanism for taking up fabric knitted by said knitting section and being delivered by said delivery rolls, said mechanism comprising:

a reel carried by said frame beneath said delivery rolls and having a center shaft upon which fabric passing from said delivery rolls is wound;

guide means carried by said frame adjacent said reel for directing the fabric onto said shaft;

cutting means carried by said frame for cutting the fabric at a location between said delivery rolls and said shaft; and pressing means carried by said frame adjacent said delivery rolls and disposed in the path of the fabric from said delivery rolls to said cutting means for pressing the fabric during passage thereof from said delivery rolls to said cutting means for preventing recapture of the cut end portion of the fabric by one of said delivery rolls.

2. A mechanism as in claim 1, wherein said pressing means is a cylindrical bar and said fabric is pressed by said bar against one of said delivery rolls.

3. A mechanism as in claim 1, wherein said pressing means is a plate and said fabric is pressed by said plate against one of said delivery rolls.

4. A take-up mechanism for a circular knitting machine for winding knit fabric into a roll, the circular knitting machine having a frame, a knitting section and a plurality of fabric delivery rolls, said mechanism comprising a reel having a center shaft upon which fabric delivered by the delivery rolls is wound;

guide means for directing the fabric onto said center shaft, said guide means comprising a plate having alternating ridges and channels on a surface thereof facing said reel;

cutting means for cutting the fabric at a location between the delivery rolls and said shaft; and pressing means for pressing the fabric during passage thereof from the delivery rolls to said cutting means for preventing recapture of the cut end portion of the fabric by the delivery rolls.

5. A take-up mechanism according to claim 4 wherein said guide plate has anti-static means on the surface thereof facing said reel.

6. In a circular knitting machine having a frame, a knitting section carried by said frame for forming a knit fabric, and a plurality of fabric delivery rolls carried by said frame beneath said knitting section for flattening and delivering the knit fabric formed by said knitting section, the combination therewith of a mechanism for taking up fabric knitted by said knitting section and delivered by said delivery rolls, said mechanism comprising a reel carried by said frame beneath said delivery rolls upon which fabric delivered by said delivery rolls is wound; and guide means carried by said frame adjacent said reel and disposed in the path of travel of the fabric from said delivery rolls to said reel for guiding the fabric from said delivery rolls onto said reel, said guide means including a plate member having a surface adapted to engage the fabric to guide the same onto said reel, said fabric guiding surface having alternating ridges and channels thereon which extend longitudinally in the direction of movement of the fabric whereby the fabric is engaged only by the crests of the ridges to minimize the area of contact between said fabric guiding surface and the fabric.

7. A knitting machine according to claim 6 wherein said fabric guiding surface includes anti-static means thereon to dissipate static electricity from the fabric.

8. A knitting machine according to claim 7 wherein said anti-static means comprises a coating of an anti-static material.

9. In a circular knitting machine having a frame, a knitting section carried by said frame for forming a knit fabric, and a plurality of fabric delivery rolls carried by said frame beneath said knitting section for flattening and delivering the knit fabric formed by said knitting section, the combination therewith of a mechanism for taking up fabric knitted by said knitting section and delivered by said delivery rolls, said mechanism comprising a reel carried by said frame beneath said delivery rolls upon which fabric delivered by said delivery rolls is wound; and guide means carried by said frame adjacent said reel and disposed in the path of travel of the fabric from said delivery rolls to said reel for guiding the fabric from said delivery rolls onto said reel, said guide means including a fabric guiding surface facing said reel and adapted to engage the fabric and guide the fabric onto said reel, and anti-static means on said fabric guiding surface for dissipating static electricity from the fabric.

* * * * *